United States Patent [19]

Simon

[11] 4,292,831

[45] Oct. 6, 1981

[54] PROCESS FOR EXTRUDING A METAL TUBE WITH INWARDLY THICKENED END PORTIONS

[76] Inventor: Joseph A. Simon, 237 Lothrop, Grosse Pointe Farms, Mich. 48236

[21] Appl. No.: 87,717

[22] Filed: Oct. 24, 1979

[51] Int. Cl.[3] ..... B21C 25/08

[52] U.S. Cl. ..... 72/260; 72/370; 72/266

[58] Field of Search ..... 72/266, 265, 260, 267, 72/370, 273, 377, 367, 368

[56] References Cited

U.S. PATENT DOCUMENTS

| | | | |
|---|---|---|---|
| 3,837,205 | 9/1974 | Simon | 72/260 |
| 3,886,649 | 6/1975 | Simon | 228/112 |
| 3,948,073 | 4/1976 | Lovell | 72/256 |
| 4,166,373 | 9/1979 | Braun | 72/356 |

FOREIGN PATENT DOCUMENTS

| | | | |
|---|---|---|---|
| 662352 | 4/1963 | Canada | 72/260 |
| 129857 | 4/1902 | Fed. Rep. of Germany | 72/266 |
| 2100600 | 9/1971 | Fed. Rep. of Germany | 72/266 |

*Primary Examiner*—Roscoe V. Parker
*Attorney, Agent, or Firm*—Cullen, Sloman, Cantor, Grauer, Scott & Rutherford

[57] ABSTRACT

A process for cold extrusion forming a metal tube with thickened end portions, including positioning a short, tubular blank in a die having an extrusion die throat, and pushing the blank through the die throat with a punch. The punch is formed with co-axial extension portions of successively smaller diameter. Thus, the first extension portion is closely fitted within the blank, while the second extension portion is aligned within the die throat as the punch end pushes the blank towards and through the die throat to thereby form the tube lead end thickened end portion. Further pushing of the blank by the punch takes place while the first extension is aligned with the die throat to thereby extrude the relatively thin wall middle portion of the tube. Next, the punch is removed, and a second blank is inserted within the die against the trailing end of the first blank. The punch is reinserted to press the second blank, which in turn pushes the first blank through the die throat while the third extension is positioned in the die throat to form an inwardly extending annular ring-like portion within the metal tube. Thereafter, further pressure by the punch, while the second die extension is again aligned within the die throat, simultaneously extrudes the metal tube trailing end thickened portion and simultaneously, the lead end thickened portion on the tube produced from the second blank.

2 Claims, 17 Drawing Figures

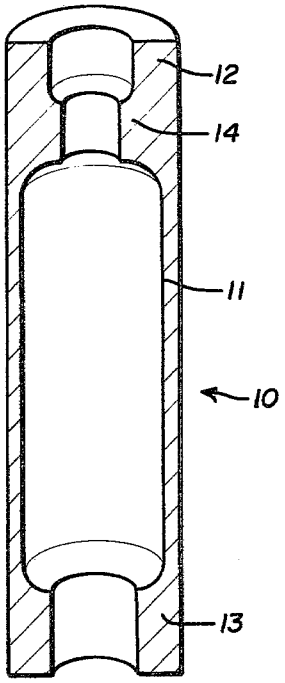
FIG. 1
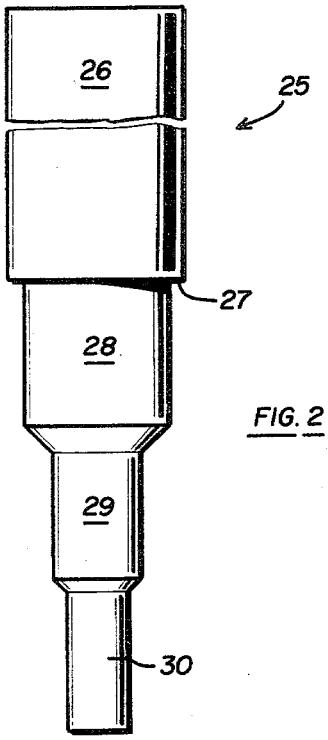
FIG. 2
FIG. 6
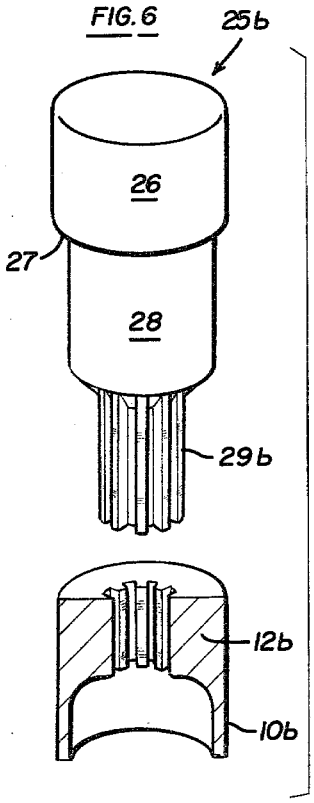
FIG. 5
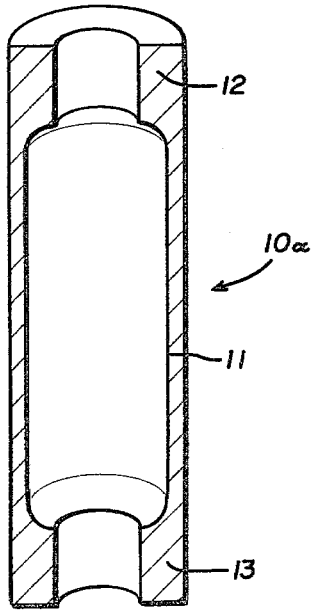
FIG. 3
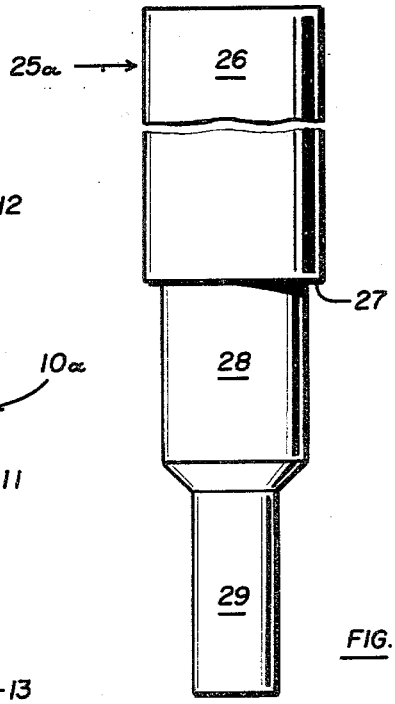
FIG. 4

PROCESS FOR EXTRUDING A METAL TUBE WITH INWARDLY THICKENED END PORTIONS

BACKGROUND OF INVENTION

The invention herein relates to a process for cold forming or extruding a metal tube with inwardly thickened end portions and a thin wall middle portion. Although this process is usable to form tubes which may be used for different purposes, this process is particularly usable to manufacture rear axle tubes used on trucks.

In my prior U.S. Pat. Nos. 3,837,205 issued Sept. 24, 1974, and, 3,886,649 issued June 3, 1975, I disclosed a process for forming metal tubes having one inwardly thickened end. These tubes were then used as parts, to which other parts were fastened to form truck type axles. The invention of this present application is concerned with forming a one-piece or integral metal tube which may be used itself as the truck axle tube without the addition of a separate major element welded thereto, as is described in my prior patents.

Truck axle tubes have been made by the cold forming or extrusion process described in my above patents, as well as by various types or forging or machining processes. These prior or conventional processes each require a number of manufacturing steps, and also, require thicker tube walls or reinforcement additions to the walls of the tubes due to the various manufacturing steps required. Consequently, the process of the present application involves certain improvements which result in permitting thinner wall thicknesses at selected portions of the tube than might be otherwise obtained through prior processes. Consequently, the finished axle tube, or similar tube, produced by this process, has required strengths and configurations, but nevertheless is lighter in weight than could normally be produced by the prior conventional processes. In addition, the tube is produced with fewer manufacturing steps, which reduces costs.

SUMMARY OF THE INVENTION

The invention herein contemplates forming a thin wall metal tube with inwardly directed ring-like or flange-like thickened portions at its opposite ends and also, an additional ring-like thickened interior portion near one end. As in the case of my prior patent, mentioned above, U.S. Pat. No. 3,837,205, the process herein includes positioning a relatively short, tubular blank within an open ended die having a die restriction throat through which the blank is extruded. The extrusion pressure is provided by a die punch formed with a ram portion which exerts a pressure against the trailing end of the blank, and punch extension portions which form mandrel-like sections which fit within the blank and die throat.

In the process of the present invention, the punch is provided with successively smaller diameter extension portions which are so sized as to be positioned within the die throat to form annular spaces within the die throat for extruding varying wall thicknesses, as desired, of the finished metal tube. In addition, the punch is so formed that as the thickened trailing edge of one metal tube is completed, the thickened lead end of the next successive blank is simultaneously formed, while that successive blank also is used as a pusher or force transmitter in extruding the preceding blank.

More specifically, the process contemplates inserting a first blank within the die, and then pushing that blank partially through the die throat by means of a punch which has a ram end shoulder engaged with and pushing against the trailing end of the blank. The punch also includes a mandrel-like extension having a first extension part which closely fits within the interior wall of the blank, and successive, smaller diameter, extension portions which function as mandrel parts. Upon initially pushing the blank through the throat, a middle extension portion is arranged within the die throat during the movement of the die so that the lead end of the blank is extruded into a relatively thickened end portion. Thereafter, further movement of the punch results in the larger extension, that is the portion normally closely fitted within the blank, to be arranged within the die throat so that the annular space within the die throat is narrower in wall thickness, thereby producing a thin wall tube middle portion.

Following substantially complete extrusion of the metal tube, i.e., its thin wall portion, the punch is removed from the die and a second, new blank is inserted within the die and the punch is reinserted. Thereafter, the punch presses the second blank, which in turn presses against the trailing end of the first, partially extruded blank while a small size diameter punch extension portion is located within the die throat to thereby produce a much thicker, ringlike, inner annular portion within the tube inner wall. Further movement of the punch locates the middle size extension portion within the die throat again. This now extrudes the trailing end of the tube thicker than the thin wall middle section, but thinner than the heavier thickened ring-like annular section. That is, the trailing end is the same thickness as the leading end thickened portion. Simultaneously, as the trailing end of the tube is extruded, the leading end of the blank is extruded into its leading end thickened portion. Consequently, as the first tube extrusion is completed, the leading end thickened portion of the successively following blank is either completed or successfully completed likewise. The cycle is then repeated, blank by blank.

As can be seen, an object of this invention is to provide an axle type metal tube of considerable length and diameter. For example, the tube may be on the order of two feet or more in length with a diameter of three to four inches, and a wall thickness as much as one-half inch in the thickened portions, although these may be considerably less. The dimensions may vary considerably depending upon the tube use requirements.

This type of tube is normally made of a suitable steel material so that when properly designed in configuration and wall thickness, it can function as a one-piece axle tube or some other correspondingly shaped tube.

An object of this invention is to provide a process for manufacturing such type tubes with inwardly thickened portions, by cold forming. That is, the process herein contemplates using unheated, room temperature steel blanks. The extrusion is carried out without the need for heating the blanks. Actually, when cold forming is performed in this manner, the blanks tend to heat up due to the extrusion effect and, for example, could become as hot as around 300 degrees F., during the extrusion. However, for all practical purposes, the blank temperature is at room temperature or at least, is not heated, to any point where there might be an affect on the metallurgical structure, such as above the transition temperatures of the metal. It is possible for some purposes to apply some heat to the blanks, but essentially this process involves cold forming, i.e., not substantially heating the metal above transition points and normally practiced at room temperature, excluding such temperature rises as might occur due to the extrusion of the metal itself.

A further object of the invention herein is to utilize a single punch within a single die, but to include the use of a second blank as if it were part of the punch or ram. The second blank functions as a locator means or spacer to extension portions within the die throat as needed. The second blank also acts as a part of the punch ram or pressure applying means. The punch functions as both a ram and a variable diameter mandrel.

These and other objects and advantages of this invention will become apparent upon reading the following description, of which the attached drawings form a part.

DESCRIPTION OF DRAWINGS

FIG. 1 is a cross-sectional perspective view of a metal axle tube having opposite thickened ends and also a ring-like annular interior enlargement.

FIG. 2 schematically illustrates a punch formation for forming the tube of FIG. 1.

FIG. 3 shows a cross-sectional perspective view of a modified tube having only thickened opposite ends, and FIG. 4 is a schematic elevational view of the punch for producing the tube of FIG. 3.

FIG. 5 is a cross-sectional perspective view of one end of a modified tube whose thickened end is provided with grooves to form a spline-like configuration, and FIG. 6 is a perspective view of a punch having a grooved or splinelike extension portion for producing the corresponding spline in the tube end portion.

DETAILED DESCRIPTION

Figure 7:
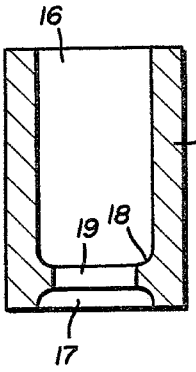
FIG. 7 is an elevational, cross-sectional view, schematically showing the die.

The process herein relates to forming one-piece or integral metal tubes, as for example, truck axle tubes of the types illustrated in FIGS. 1, 3 and 5. Thus, referring to FIG. 1, the axle tube 10 is formed of a suitable metal, such as a pre-selected steel material, with the tube comprising an elongated, thin wall middle portion 11, opposite, inwardly thickened end portions 12 and 13, and an intermediate ring-like annular portion 14. The thickened end portions 12 and 13 provide areas for further machining, or for the securement of additional parts, such as bearings, differential casing parts, etc. The annular thickened portion 14 also provides material for further machining, receipt of a bearing or to function as a journal bearing or as a strengthened or reinforced area, etc. In essence, the tube is of a thin wall type, but provided with integral thickened end portions which are inwardly thickened, along with a further inwardly extending ring or flange like portion to provide an area within the tube of smaller interior diameter than adjacent areas.

FIG. 3 illustrates an alternative form of the tube 10*a*, which, like tube 10 of FIG. 1, includes a thin wall middle portion 11 and opposite thickened ends 12 and 13, but does not include additional inwardly directed ring-like formations such as 14 of FIG. 1.

FIG. 5 illustrates another modified form of tube 10*b*, which is similar to either tube 10 or 10*a* except that one or more of its interior thickened portions 12*b* may be formed with grooves or a spline-like shape by appropriately formed grooves in one or more of the die parts.

The process of forming the above described tubes begins with a die 15 which is mounted upon a suitable conventional press (not shown). Conventional presses include a bed or support portion upon which a die is mounted. Since such presses are widely used and well known, no further description is included herein.

The die 15, is formed like a cylinder or tube, with an inlet end 16 and an outlet end 17, between which is located an annular, inwardly directed shoulder or restriction 18 which forms the constricted die throat 19 through which the extrusion takes place. FIG. 7 illustrates the die schematically, as if mounted in a vertical position upon a vertical type press. Alternatively, the die can be mounted with its axis horizontally in a horizontal operating type of press.

Figure 8:
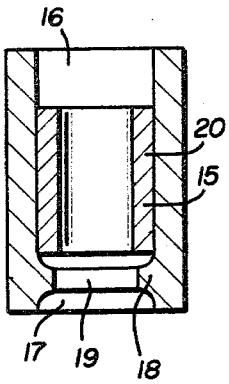
FIG. 8 through 16, inclusive, schematically illustrate the successive steps in cold forming or extruding a complete tube of the type shown in FIG. 1.

As shown in FIG. 8, a metal blank 20 is inserted within the die through the inlet end. The blank is a relatively short tube of a pre-selected length and wall thickness. Its I.D. is smaller than the diameter of the die throat 19.

The extrusion or cold forming of the metal blank 20 through the die throat 19 is accomplished by means of a punch or ram 25. The punch includes an outer ram portion 26 which is engaged by the press ram or pressure applying platten for applying a pressure upon the punch in an amount suitable to extrude or cold form the metal blank. The ram portion includes an inner, relative to the die, annular ram forming shoulder 27 which directly engages the trailing end of the blank for exerting an axially directed force thereon.

Figure 9:
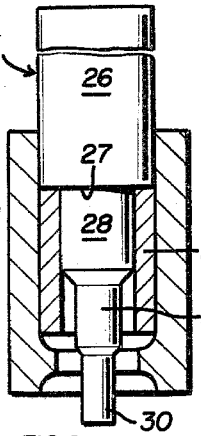

The punch also includes a mandrel-like extension which extends through the blank and the die throat. The extension is formed in multiple steps of successively smaller diameter. Thus, the larger diameter step portion 28 closely fits within the interior of the blank, as illustrated in FIG. 9. Successively smaller extension portions, namely second extension portion 29 and the smaller third extension portion 30 extend through a portion of the blank and die throat as illustrated in FIG. 9. The diameter of the first or larger extension portion 28 corresponds to the predetermined I.D. of the tube thin wall portion 11. The O.D. of the second or middle extension portion 29 corresponds to the I.D. of the thickened tube end portions 12 and 13. The O.D. of the third, smallest, extension portion 30 corresponds to the I.D. of the ring-like formation 14 illustrated in FIG. 1. If additional, different size ring-like formations, similar to that of 14, but of smaller I.D., as desired, additional steps or extension portions may be provided upon the die.

Figure 10:
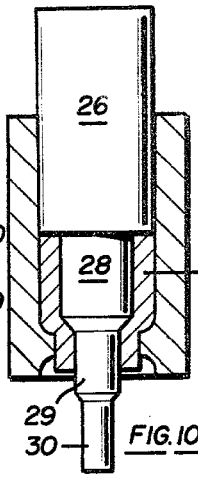

As shown in FIG. 10, the punch is moved, by means of the corresponding press element, axially towards the die throat so that it pushes the trailing end of the blank to thereby cause the leading end of the blank to flow through the die throat. At that point, the middle punch extension 29 is positioned within the die throat so that the blank material is extruded through the annular space formed by the punch extension 29 and the wall defining the die throat. This forms the thickened leading end portion 13 of the tube.

Figure 11:
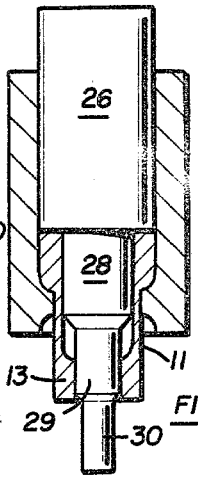

Further movement of the punch, as illustrated by the arrow in FIG. 11, results in the second or middle punch extension moving below the die throat and the first or larger punch extension 28 moving into position within the die throat. This extrudes the thin wall portion 11 of the tube. During the extrusion process, the extruded tubular wall moves axially at a much greater rate than does the punch so that the length of extruded tube considerably exceeds the axial length of the extension portion arranged within the die throat. Thus, by appropriate experimentation or try-outs, the length of the punch extensions can be established to produce pre-determined length tubular wall portions.

Figure 12:
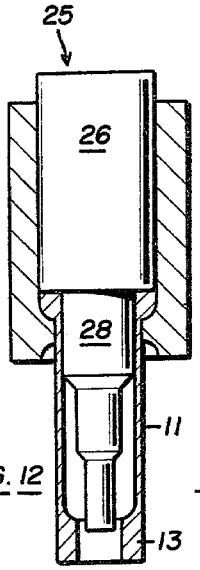
Figure 13:
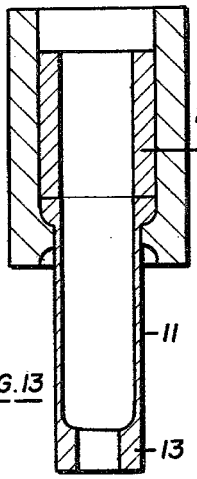

Next, turning to FIG. 12, the punch is stopped when the tube is almost completely extruded through the die throat, leaving a bell-shaped unextruded trailing end portion. At this point, the punch is retracted or removed from the die. Then, as shown in FIG. 13, a second or new blank 20*a* is inserted within the die. This second blank is arranged in end to end contact with the unextruded portion of the first blank.

Figure 14:
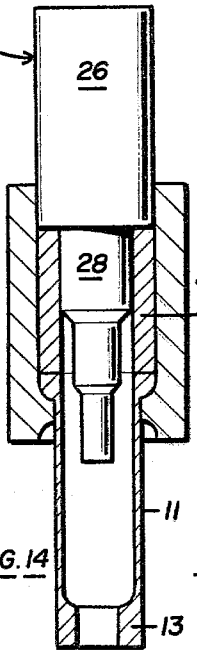
Figure 15:
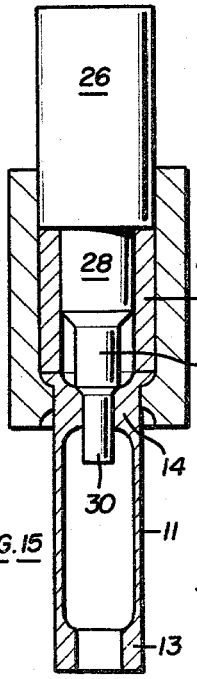

As shown in FIG. 14, the punch 25 is reinserted into the die so that its annular ram-like shoulder 27 now engages the trailing end of the second blank. Because of the spacer effect of the second blank, movement of the punch in the axial direction, as indicated by the arrow in FIG. 15, now results in the third or smaller extension portion 30 being located in the die throat. The axially directed pressure upon the blank 20*a* pushes the unextruded end portion of the first blank through the annular space between the extension 30 and the die throat wall to form the inner, ring-like enlargement 14.

Figure 16:
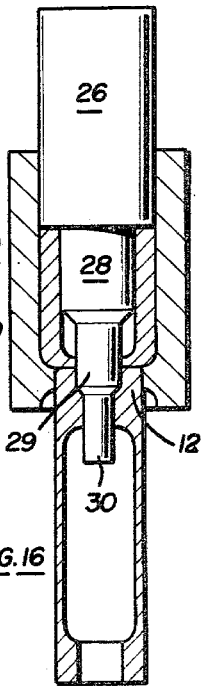

After the enlargement 14 is cold formed or extruded, continued movement of the punch, as shown in FIG. 16, results in the middle or second die extension, portion 29, moving within the die throat so that the very end of the partially extruded blank is now extruded between extension 29 and the die throat. This forms the inward thickened end portion 12 which corresponds in thickness to the leading thickened end portion 13.

The second blank functions as if it were a part of the punch ram and also functions as a spacer to appropriately space the punch extensions within the die throat as mentioned above. Further, as the trailing end of the first blank is extruded to form the thickened end 12, the leading end of the second blank is simultaneously extruded to form its leading end thickened portion 13. Thus, that single step of the movement of the punch completes the thickened trailing end portion on one blank and the leading thickened end portion on the following blank.

The completed tube, following the step of FIG. 16, is removed from the die and is in the configuration shown in FIG. 1. Meanwhile, the cycle is repeated for continuous production of such tubes.

Figure 17:
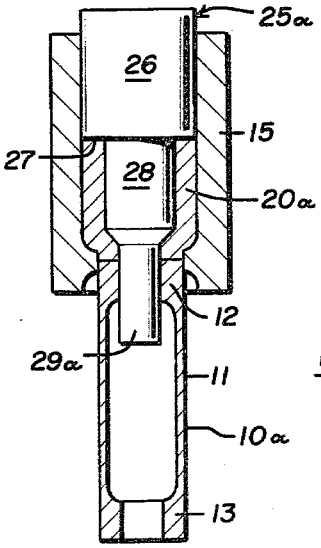
FIG. 17 is a schematic view, in cross-section, showing the concluding step in forming the modified tube of FIG. 3.

The modification illustrated in FIG. 3 is produced with a punch 25*a* which has the smaller or third extension portion 30 omitted. That is, punch 25*a* includes the same ram portion 26, annular ram shoulder 27, first extension portion 28 and a longer second extension portion 29*a* corresponding to the punch of FIG. 2. The punch 25*a*, is used within the same die 15. FIG. 17 illustrates the last step in the extrusion of the tube of FIG. 3 showing the punch extension 29 located within the die throat for completing the thickened trailing end 12 of the tube 10*a* and forming the thickened leading edge of the following blank. The process is the same as that shown in FIGS. 7 through 14, with FIG. 17 showing the step which replaces the steps of FIGS. 15 and 16 described above.

The modified tube of FIG. 5, i.e., with spline-like or groove-like formations in one or more of its thickened end portions, is produced by a modified punch 25*b*. Such modified punch, shown in FIG. 6, includes the same ram portion 26, ram shoulder portion 27 and first extension portion 28 as that of FIGS. 2 and 4. However, its lower extension portion 29*b* is provided with suitable grooving to thereby produce a grooved or spline-like thickened portion 12*b* in the modified tube 10*b*. Otherwise, the process is the same as that described above. Further, the spline or grooves can be formed in the smallest extension portion 30 or the largest extension portion 28, of the punch illustrated in FIG. 2, so as to groove or spline the corresponding portion of the finished tube either alternatively or along with the end portions 12 and 13.

Having fully described an operative embodiment of this invention, I now claim:

1. A process for extruding a metal tube with inwardly extending, annular, ring-like thickened end portions, comprising the steps of:

positioning a relatively short, tubular blank within an open ended, tubular die having an inlet end through which the blank is inserted and an opposite extrusion end formed by an annular, inwardly extending, continuous shoulder forming a die extrusion throat, through which the blank is extruded, with the throat diameter being larger than the inner diameter of the blank;

inserting a punch into the die inlet end, which punch has a portion closely fitted within the die and is provided with an annular shoulder for engaging against the free end of the blank, and also having a punch extension, axially aligned with the blank and die throat, with the punch extension having a series of successively smaller diameter extension portions;

arranging the largest diameter punch extension, i.e., the extension portion closely fitted within and in face to face contact with the inner wall of the blank, within the die throat while moving the punch towards the die throat so that its shoulder pushes the trailing end of the blank to thereby extrude a portion of the blank through the annular space between said larger diameter extension portion and the die throat to consequently form a relatively thin wall tube portion;

removing the punch and inserting a second blank within the die, and reinserting the punch into the die so that movement of the punch engages and pushes the trailing end of the second blank, which in turn, pushes the first, partially extruded blank through the die throat;

next, skipping the next smaller diameter punch extension portion and instead aligning the following smaller punch extension portion within the die throat while continuing to move the punch so as to extrude a portion of the blank through the annular space in the die throat formed thereby, to thereby form a thickened, ring-like formation within the interior of the tube;

then, aligning the previously skipped extension portion within the die throat and continuing the movement of the punch to extrude a successive portion of the blank through the die throat annular space formed thereby to produce a tube wall portion of greater interior diameter than the previously mentioned thickened ring-like interior formation.

2. A process for extruding a metal tube with inwardly extending, annular, ring-like thickened end portions at both of its ends, comprising the steps of:

positioning a relatively short, tubular blank within an open ended, tubular die having an inlet end through which the blank is inserted and an opposite extrusion end formed by an annular, inwardly extending, continuous shoulder forming a die extrusion throat through which the blank is extruded, and with the throat diameter being larger than the inner diameter of the blank;

inserting a punch into the die inlet end, with the punch closely fitted within the die and having an annular shoulder engaged against the free end of the blank and having a first punch extension closely fitted within and in full contact with the interior wall of the blank, and having a second punch extension of a smaller diameter than the blank interior diameter extended through part of the blank and die throat, and having a third punch extension, which is formed on the punch co-axial with and extending from the second punch extension, but of smaller diameter than the second punch extension, with the punch shoulder and punch extensions being located co-axially with each other and also with the blank and die throat, and with the second punch extension being located between the first and third punch extensions;

next, moving the punch towards the die throat so that the punch shoulder rams the blank towards the die throat, and simultaneously aligning the second punch extension with the die throat to thereby extrude the lead end of the blank through the annular space between said second punch extension and the die throat to thereby form one thickened end of the metal tube;

continuing moving the punch while aligning the first punch extension with the die throat so as to thereby extrude the blank through the annular space between the first punch extension and the throat to form a relatively thin wall metal tube middle portion;

then removing the punch from the die, and inserting a second tubular blank within the die in full end to end contact with the trailing end of the partially extruded blank;

reinserting the punch in the die with its punch shoulder engaging the trailing end of the second blank and with the punch first extension closely fitted within the second blank;

arranging the third punch extension within the die throat, after the step of reinserting the punch;

moving the punch towards the die throat to extrude a portion of the first, partially extruded, blank through the annular space between the die throat and the third extension to thereby form an annular, ring-like enlargement within the tube;

and thereafter moving the punch in the direction of the die throat while aligning the second, smaller diameter, punch extension with the die throat, so that the second blank pushes the remainder of the first, partially extruded, blank through the annular space between the second punch extension and the die throat to form an inwardly thickened end portion on the trailing end of the first blank, and also, simultaneously extruding an inwardly thickened end portion on the leading end of the second blank;

then removing the extruded first blank and continuing and repeating the cycle on the second and successive blanks; and forming groove spline-like formations on at least one of the metal tube portions by providing grooves on one of the punch extensions so that the metal extruded through the space between that one punch extension and the die throat is correspondingly grooved.

* * * * *